US008210309B1

(12) United States Patent
Schlosser et al.

(10) Patent No.: US 8,210,309 B1
(45) Date of Patent: Jul. 3, 2012

(54) CHANNELING GAS FLOW TUBE

(75) Inventors: Thomas George Schlosser, Maple Valley, WA (US); George Paul Schlosser, Renton, WA (US)

(73) Assignee: Parallaxial Innovation LLC, Renton, WA (US)

( * ) Notice: Subject to any disclaimer, the term of this patent is extended or adjusted under 35 U.S.C. 154(b) by 153 days.

(21) Appl. No.: 12/238,253

(22) Filed: Sep. 25, 2008

(51) Int. Cl.
*F01N 13/02* (2010.01)

(52) U.S. Cl. ..... 181/232; 181/227; 181/228; 181/231; 181/212; 181/262

(58) Field of Classification Search ..... 181/212, 181/227, 231, 232, 262, 263, 264, 265, 249, 181/248, 268, 250, 251, 272, 282
See application file for complete search history.

(56) References Cited

U.S. PATENT DOCUMENTS 1,611,475 A * 12/1926 Maxim ..... 181/249
2,248,456 A * 7/1941 Harris ..... 181/262
4,286,689 A * 9/1981 Malmsten ..... 181/232
5,269,132 A * 12/1993 Loucks ..... 60/204
6,347,609 B1 * 2/2002 Bloomer ..... 123/184.57

* cited by examiner

*Primary Examiner* — Forrest M Phillips

(74) *Attorney, Agent, or Firm* — Galvin Patent Law LLC; Brian R. Galvin

(57) ABSTRACT

A tube comprises a series of guides with each successive guide smaller than a next prior guide forms an effective funnel with a smaller end extending toward into a larger end of a next adjacent guide. The larger end of the next adjacent guide extends past the smaller end of that prior guide and loops back to taper into smooth connection to the outside of the smaller end of that prior guide therein creating a cavity in the guide. Gas passing rapidly past the cavities causes a Bernoulli effect that reduces pressure within the cavities. Because the mouth of the guides is large, a vortex is induced from a shearing interface between gases within the cavity and the main flow of gas moving down the tube. A less energetic layer of gas is created that buffers tube guides from main gas flow through the tube center.

20 Claims, 4 Drawing Sheets

CHANNELING GAS FLOW TUBE

BACKGROUND

1. Field of the Invention

This invention pertains to tubes through which a fluid may move, and more particularly, to such a tube that channels gases, and articles suspended in a gas flow, centrally or axially down the tube.

2. Background

Back pressure in engine exhausts is a well known phenomenon that robs energy from the engine. Mufflers and catalytic converters contribute to the back pressure.

It is the primary object of the present invention to provide a tube functional as an exhaust pipe that reduces back pressure and reduces or eliminates the need for a muffler.

SUMMARY

A tube includes a series of guides with each successive guide smaller than a next prior guide. The tube thus forms an effective funnel ending at a tube exit end smaller than a tube entry end. The guides are arranged longitudinally with a smaller end extending toward the exit end extending into a larger end of a next adjacent guide. The larger end of the next adjacent guide extends past the smaller end of its prior flow guide and loops back to taper into smooth connection with the outside of the smaller end of that prior flow guide therein creating a cavity in the guide.

The collection of the guide smaller ends defines a continuous curved inner line defining an effective inner wall of the tube that funnels gradually and smoothly from the entry end to the exit end. That curved inner line may be logarithmic or parabolic or another continuous curved line. A continuous outside line that tangentially contacts each of the guides outside of the tube may also be drawn between the guides. The outside line may also be straight, logarithmic or parabolic or any other curved continuous line, though having a higher rate of curvature than does the inner curved line.

Gas passing rapidly past the guide cavities causes a Bernoulli effect reducing pressure within the cavities. Because the mouth of the guides are large, a vortex is induced from a shearing interface between gases within the cavity and the main flow of gas moving down the tube translating kinetic energy from the main flow into the vortex in the respective cavities.

It has been empirically shown that when the tube is installed as an automobile exhaust pipe, gas exits the tube with reduced sound and more efficiently as measured by increased gas mileage for the vehicle. It has also been shown empirically that when the tunnel is employed as a chute, solid items such as fruit or balls are buffered from the tunnel interior wall and accelerate through the chute tunnel without hitting the tunnel interior wall as primary gas flow is channeled to the center of the tube, thus preserving the fruit or other item from damage from the side of the tube. It is therefore concluded that the vortices work to form a buffer from the tube inner walls. The result then is an outer layer of gas moving past the vortices and the tunnel interior wall slower than the inner flow of gas nearer the center of the tube. The inner layer then comprises the observed buffer to the inner flow of gas and objects in the inner flow.

When installed as part of an engine exhaust pipe as mentioned above, the device has been found to be an effective muffler without using baffles. It has also been found that a change in the dimensions of the guides changes the engine exhaust sound. The inventor suggests that the guides induce a density gradient with heavier particles moving to the center of the gas flow and lighter particles moving outward toward the tube interior surface and the vortices. It is suspected that this organization of particles reduces or eliminates compression waves that are found in conventional automobile exhaust systems. It is also suspected that the funneling effect of the outer gas flow along the tube inner wall contributes to a partial destruction of compression waves in the exhaust. The outer gas layer also acts as a smooth boundary to the inner flow which promotes even flow to the inner flow.

DETAILED DESCRIPTION OF THE PREFERRED EMBODIMENTS

Figure 1:
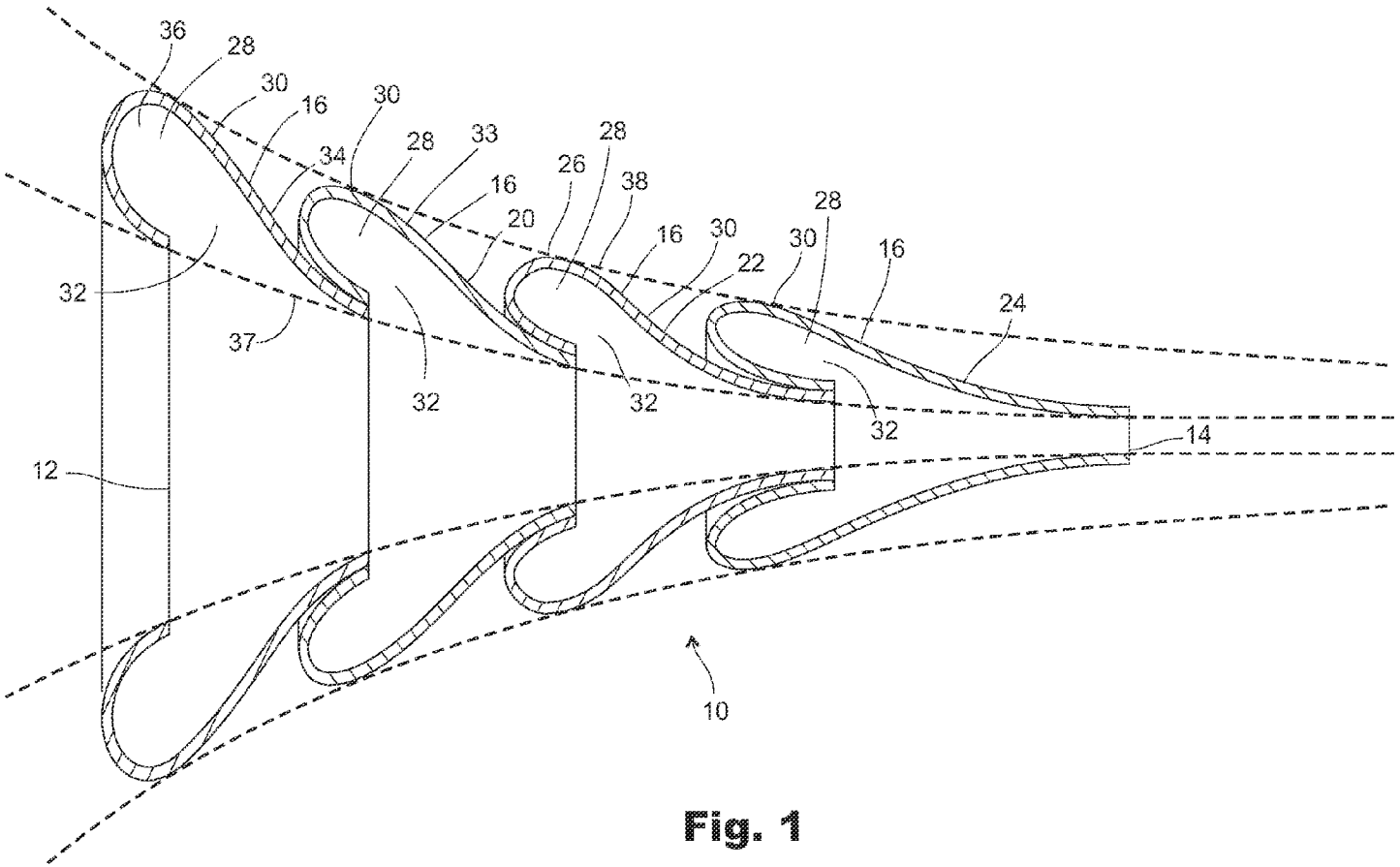
FIG. 1 is a longitudinal cross sectional view of the tube of the invention.
Figure 2:
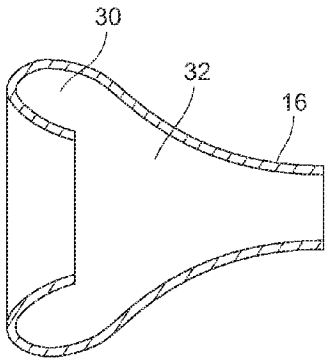
FIG. 2 is a longitudinal cross section view of a typical guide of which the tube of FIG. 1 is comprised.
Figure 3:
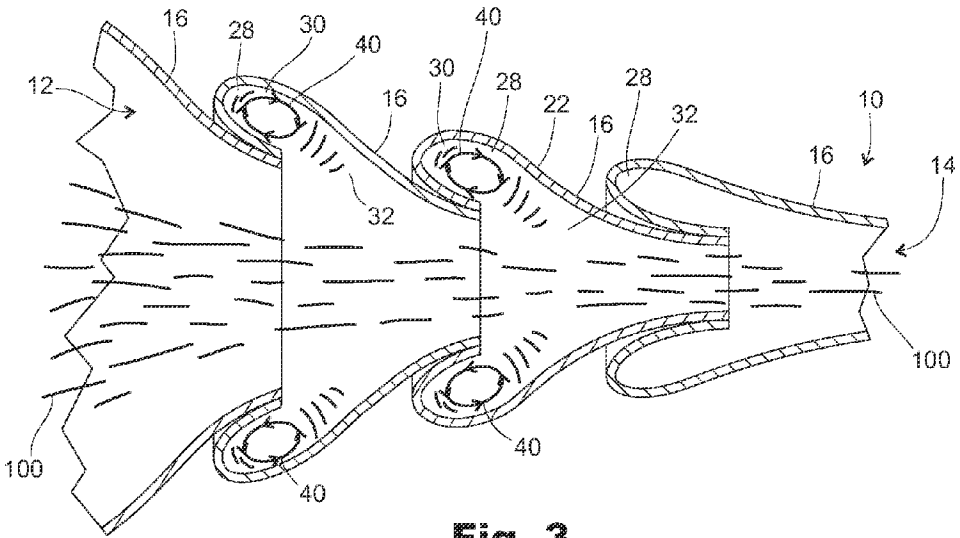
FIG. 3 is a longitudinal cross section view of a portion of the tube of FIG. 1 showing vortices in cavities of the respective guides comprising the tubes.
Figure 4:
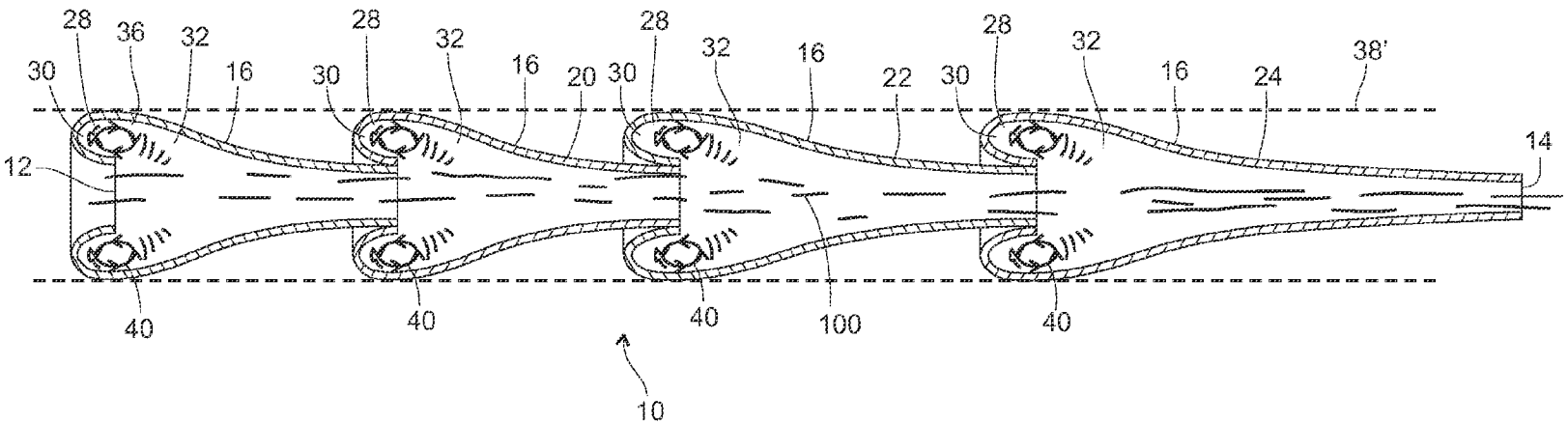
FIG. 4 is a longitudinal cross sectional view of an alternative embodiment of the tube showing an external straight line comprised of a plurality of guides with cavities in which vortices are formed as gas passes the cavities.
Figure 5:
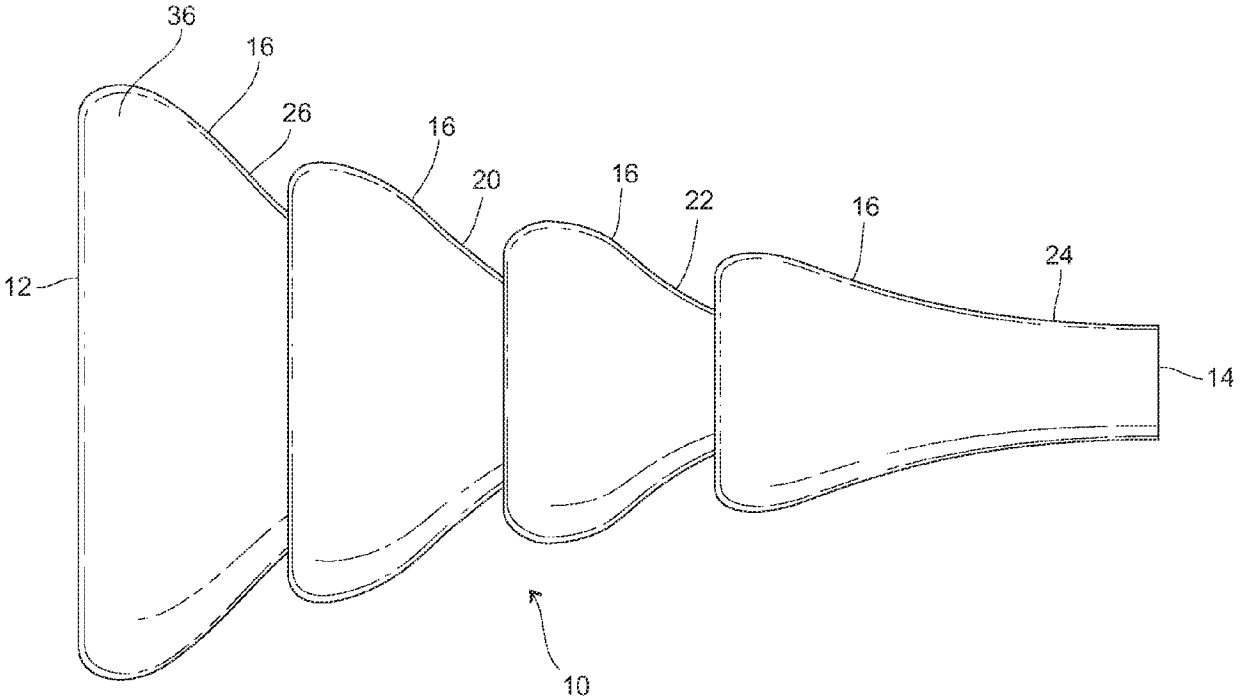
FIG. 5 is a perspective view of the tube of FIG. 1.

The tube 10 of the present invention for moving gas 100 and for moving articles within the gas is defined between an entry end 12 into which gas 100 is introduced and an exit end 14 through which gas 100 exits the tube 10. The tube 10 comprises a plurality of adjoining adjacent guides 16, each guide 16 comprising an outer half of a modified torus forming toroidal groves opening inward. Each guide 20 is adjacent a next guide 22 except of course the last guide 24 which ends the tube 10. The plurality of adjacent guides 16 connected together at their mouths 18 forms a closed tube wall 26 with each guide 16 forming a cavity 28 with a cavity wall 30 around the cavity 28 and a cavity mouth 32 opening into the tube 10.

In the primary embodiment the cavity wall 30 of a guide 33 extends upward beyond its mouth 32, that is, toward the entry end 12, over a next prior adjacent guide 34, again except a first guide 36 at the entry end 12 which is also shaped generally similar to the other guides but does not extend over a prior guide.

The plurality of guides 16 is disposed such that the mouths 32 of the guides 16 are aligned along a curved inner line 36 between the entry and exit ends 12, 14. The curved inner line 37 may be logarithmic or parabolic or another form of a continuous curved line. Also, a outer line 38 tangential to cavity walls 30 of said plurality of guides 16 outside of the tube 10 is curved, which line may be logarithmic, parabolic or another form of a continuous curved line. Clearly, the line 38 outside the tube 10 has a curvature greater than the curved inner line 36 past the guide mouths 32.

The guides 16 are shaped such that a vortex 40 forms within each of said cavities 28 as gas 100 passes through the tube 10 while promoting a smooth flow through the tube10. Thus, the cavity wall 30 of each flow guide 16 in extending past the next prior flow guide 34 loops back toward the exit end 14 to taper into smooth connection with that next prior flow guide 34. The guides are16 are generally nozzle shaped with each successive guide being smaller than a next prior guide such that gas entering the entry end 12 is funnelled through the tube 10 and out the exit end 14 which is smaller than the entry end 12.

In an alternate embodiment, the plurality of guides 16 is disposed such that the outer line 38' tangential to cavity walls of said plurality of guides outside of the tubes is straight.

Having described the invention, we claim the following:

1. A tube for moving gas between an entry end into which gas is introduced and an exit end through which gas exits the tube, comprising:

a plurality of adjoining adjacent guides, each guide comprising an outer half of a smoothly-curved, modified torus;

wherein the plurality of adjoining guides collectively forms a closed tube wall and the guides are arranged axially along an axis running through the center of rotation of each guide; and wherein each guide forms an internal cavity with a cavity mouth opening into an inner portion of the tube;

further wherein flow of fluid in the tube is unidirectional and axial from the entry end to the exit end.

2. The tube of claim 1 wherein a cavity wall of a guide extends over the next prior guide toward the entry end except a first guide at the entry end which is also shaped generally similar to the other guides.

3. The tube of claim 1 wherein the plurality of guides is disposed such that the mouths of the guides are aligned along a curved inner line between the entry and exit ends.

4. The tube of claim 3 wherein the curved inner line is logarithmic.

5. The tube of claim 3 wherein the curved inner line is parabolic.

6. The tube of claim 1 wherein a line tangential to cavity walls of said plurality of guides outside of the tubes is straight.

7. The tube of claim 1 wherein a line tangential to cavity walls of said plurality of guides outside of the tubes is curved.

8. The tube of claim 7 wherein a line tangential to cavity walls of said plurality of guides outside of the tubes is logarithmic.

9. The tube of claim 7 wherein a line tangential to cavity walls of said plurality of guides outside of the tubes is parabolic.

10. The tube of claim 1 wherein the guides are shaped such that a vortex forms within each of said cavities as gas passes through the tube.

11. The tube of claim 2 wherein said guides are shaped with each successive guide being smaller than a next prior guide such that gas entering the entry end is funneled through the tube and out the exit end which is smaller than the entry end.

12. The tube of claim 11 wherein the cavity wall of a flow guide in extending past the next prior flow guide loops back to taper into smooth connection with that next prior flow guide, smaller ends of guides thus extending into a larger ends of a next adjacent guides.

13. A tube for moving gas with an entry end into which gas is introduced and an exit end through which gas exits the tube, comprising:

a plurality of adjoining adjacent guides, each guide comprising an outer half of a smoothly curved modified torus therein forming a closed tube wall with each guide forming a cavity with a cavity mouth opening into the tube;

wherein said cavity wall extends toward the entry end over a next prior adjacent guide except a first guide at the entry end which is also shaped like the other guides; and wherein the plurality of guides is disposed such that the mouths of the guides are aligned along a curved inner line between the entry and exit ends wherein said guides are shaped with each successive guide being smaller than a next prior guide such that gas entering the entry end is funneled through the tube and out the exit end which is smaller than the entry end;

and wherein flow of fluid in the tube is unidirectional and axial from the entry end to the exit end.

14. The tube of claim 13 wherein the curved inner line is logarithmic.

15. The tube of claim 13 wherein a line tangential to cavity walls of said plurality of guides outside of the tubes is curved.

16. The tube of claim 13 wherein the guides are shaped such that a vortex forms within each of said cavities as gas passes through the tube.

17. The tube of claim 13 wherein the cavity wall of a flow guide in extending past the next prior flow guide loops back to taper into smooth connection with that next prior flow guide.

18. A tube for moving gas with an entry end into which gas is introduced and an exit end through which gas exits the tube, comprising:

a plurality of adjoining adjacent guides, guide comprising an outer half of a smoothly curved modified torus therein forming a closed tube wall with each guide forming a cavity a cavity mouth opening into the tube wherein said cavity wall extends toward the entry end over a next prior adjacent guide except a first guide at the entry end which is also shaped like the other guides and wherein the plurality of guides is disposed such that a line tangential to cavity walls of said plurality of guides outside of the tube is straight;

and wherein flow of fluid in the tube is unidirectional and axial from the entry end to the exit end.

19. The tube of claim 18 wherein the guides are shaped such that a vortex forms within each of said cavities as gas passes through the tube.

20. The tube of claim 18 wherein the cavity wall of a guide in extending past the next prior guide loops back to taper into smooth connection with that next prior flow guide, smaller ends of guides thus extending into a larger ends of a next adjacent guides.

* * * * *